US007509692B2

(12) United States Patent
Elkins et al.

(10) Patent No.: US 7,509,692 B2
(45) Date of Patent: Mar. 31, 2009

(54) WEARABLE PERSONAL COOLING AND HYDRATION SYSTEM

(75) Inventors: William Elkins, Lincoln, CA (US); Kenneth L. Blanchard, Vacaville, CA (US); Maurice Jordan, Antioch, CA (US)

(73) Assignee: bioCOOL technologies, LLC, McClellan, CA (US)

( * ) Notice: Subject to any disclaimer, the term of this patent is extended or adjusted under 35 U.S.C. 154(b) by 563 days.

(21) Appl. No.: 11/127,866

(22) Filed: May 11, 2005

(65) Prior Publication Data

US 2006/0191049 A1 Aug. 31, 2006

Related U.S. Application Data

(60) Provisional application No. 60/570,401, filed on May 11, 2004.

(51) Int. Cl.
*A41D 1/04* (2006.01)
*F28F 7/00* (2006.01)

(52) U.S. Cl. ..... 2/458; 2/102; 2/7; 165/46; 62/259.3

(58) Field of Classification Search ..... 2/458, 2/7, 8, 84, 108, 69, 102, 81, 85, 93, 94; 165/46, 165/297, 104.14, 120, 296, 170, 138; 62/259.3, 62/530; 224/148.1–148.7; 607/104, 108–110, 607/114

See application file for complete search history.

(56) References Cited

U.S. PATENT DOCUMENTS 4,149,541 A 4/1979 Gammons
4,691,762 A 9/1987 Elkins
4,856,294 A 8/1989 Scaringe
5,062,269 A 11/1991 Siegel
5,146,757 A * 9/1992 Dearing ..... 62/61

(Continued)

FOREIGN PATENT DOCUMENTS

WO WO 03/102480 12/2003

(Continued)

OTHER PUBLICATIONS

Life Support Systems, Inc.; M2DS Cooling System Price List; Jan. 1, 1994.

(Continued)

*Primary Examiner*—Amy B Vanatta
(74) *Attorney, Agent, or Firm*—Heisler & Associates

(57) ABSTRACT

A heat transfer fluid pathway is provided driven by a pump which feeds the heat transfer fluid through a vest and cap or other heat transfer garment, where the heat transfer fluid draws heat away from the body of the wearer. A drinkable heat sink material is located within a removable cartridge located within a heat exchange pouch. The heat transfer fluid passes from the heat transfer garment to the heat exchange pouch where heat drawn from the wearer is transferred to the heat sink material within the cartridge. A temperature control valve is provided along with a bypass line so that an adjustable amount of the heat transfer fluid is routed to the heat exchange pouch for temperature control. A supply of elevated pressure air is optionally provided to maintain optimal contact for efficient heat transfer within the heat exchange garment and the heat exchange pouch.

17 Claims, 9 Drawing Sheets

U.S. PATENT DOCUMENTS

| | | | | |
|---|---|---|---|---|
| 5,201,365 | A * | 4/1993 | Siegel | 165/46 |
| 5,224,349 | A | 7/1993 | Siegel | |
| 5,524,293 | A | 6/1996 | Kung | |
| 5,901,889 | A | 5/1999 | Ho | |
| 5,967,225 | A * | 10/1999 | Jenkins | 165/46 |
| 6,178,562 | B1 | 1/2001 | Elkins | |
| 6,220,490 | B1 * | 4/2001 | O'Hara | 224/148.2 |
| 6,276,155 | B2 * | 8/2001 | Siman-Tov et al. | 62/259.3 |
| 6,497,348 | B2 | 12/2002 | Forsman | |
| 6,942,015 | B1 * | 9/2005 | Jenkins | 165/46 |
| 6,993,930 | B2 * | 2/2006 | Blackstone | 62/421 |
| 2003/0019476 | A1 * | 1/2003 | Chambers | 123/438 |
| 2004/0079517 | A1 | 4/2004 | Bueley | |
| 2004/0128747 | A1 * | 7/2004 | Bumbarger et al. | 2/458 |

FOREIGN PATENT DOCUMENTS

| | | |
|---|---|---|
| WO | WO 2004/033044 | 4/2004 |

OTHER PUBLICATIONS

Life Support Systems, Inc.; Maintenance Operations Manual for the M2DS MultiCrew MicroClimate Drinking System; Sep. 1993.

Life Support Systems, Inc.; Integrated Cooling System Price List; Jan. 1, 1993.

Life Support Systems, Inc.; Integrated Cooling System Product Sheet; Circa 1993.

National Aeronomics and Space Administration; Spinoff 93; Cover and pp. 54-55; 1993.

Huan Wang, M.D., et al.; Rapid and Selective Cerebral Hypothermia Achieved Using a Cooling Helmet; J. Neurosurg.; Feb. 2002; pp. 272-277; vol. 100.

* cited by examiner

WEARABLE PERSONAL COOLING AND HYDRATION SYSTEM

CROSS-REFERENCE TO RELATED APPLICATIONS

This application claims benefit under Title 35, United States Code §119(e) of U.S. Provisional Application No. 60/570,401 filed on May 11, 2004.

FIELD OF THE INVENTION

The following invention relates to heat transfer systems, and particularly cooling systems for cooling an individual, and which are worn by the individual. More particularly, this invention relates to wearable cooling systems and associated garments, such as to maintain comfort and personal performance in high temperature environments.

BACKGROUND OF THE INVENTION

The human body is only capable of effective performance and survival within a relatively narrow range of temperatures. Hence, the body includes temperature control systems to maintain optimal bodily function and health. In particular, the human body is configured to sweat moisture through the skin so that when this moisture evaporates, evaporative cooling takes place on the surface of the skin to cool the individual. When excessive cold is encountered, the body may initiate a shivering reflex such that additional heat is generated to compensate. These and other body temperature systems are not entirely adequate to deal with all of the ranges of temperature which a human is likely to encounter in many circumstances. Hence, it has been known throughout the ages for individuals to augment their own body temperature control systems with appropriate clothing. When colder temperatures are encountered, warmer clothing is worn. When hotter temperatures are encountered less and lighter clothing is worn; or alternatively clothing which tends to reflect sunlight or which enhances the prevalence of shade.

While the wearing of different amounts of clothing is generally effective in compensating for excessively cold environments, climates exist where temperatures are sufficiently high that clothing modifications alone are not sufficient to maintain optimal body temperature and personal performance. In particular, deserts present a challenging environment in that temperatures up to or even exceeding 140 degrees Fahrenheit can be encountered. When other features of the desert environment (including lack of trees or other shade structures, and radiation of heat from the ground and surrounding structures) is taken into account, the heat load on an individual can further tax the natural and artificial systems used by the individual to maintain adequate body temperature for optimal personal performance in the desert environment.

In such environments the evaporative cooling associated with sweating and maintaining body temperature requires that exceptionally large amounts of fluids be consumed. With the consumption of such large amounts of liquid, electrolyte balances within the individual are difficult to maintain and other difficulties are also encountered, including the uncomfortableness associated with excessive sweating. Accordingly, a need exists for improved systems for actively cooling the body of an individual when the individual is in a high temperature environment, such as a desert.

Likewise, hot jungle temperatures, although lower than in the desert, with humidity approaching 100% and eliminating effective use of evaporative cooling of the body by sweat or by artificial evaporation of water, present a need for improved body cooling systems.

SUMMARY OF THE INVENTION

With this invention, a personal cooling and hydration system is provided which can be worn by the user and both provides cooling for the user and a source of drinkable fluid to augment the body's natural temperature control systems. A vest and cap or other garment is worn by the user which includes a heat transfer fluid pathway extending therethrough. The heat transfer fluid passes through this pathway and absorbs heat from the wearer.

Preferably, this garment is in the form of both a vest and a cap so that heat absorption into the heat transfer fluid and cooling for the wearer can be maximized. This thus heated heat transfer fluid is then routed to a heat sink where the heat transfer fluid is cooled and the heat in the heat transfer fluid is passed to the heat sink material.

The heat sink is preferably in the form of a removable cartridge which can be born by the wearer, preferably within a backpack. This heat sink cartridge is preferably a water or other drinkable fluid container which begins in the form of ice. As the heat transfer fluid draws heat away from the wearer and delivers it to the heat sink, the ice melts. A drinking tube is coupled to an outlet of the cartridge so that the wearer (or others) can utilize the drinking tube to drink fresh recently melted water. The cooled heat transfer fluid then returns back to the garment for further cooling of the wearer.

Most preferably, not all of the heat transfer fluid is routed to the heat sink, such as the water/ice filled cartridge. Rather, two parallel paths are provided for the heat transfer fluid, including a hot path which bypasses the heat sink and a cold pack which is routed to the heat sink. A temperature control valve divides the flow of heat transfer fluid between the hot and the cold path. Preferably, this temperature control valve is adjustable by the user, so that the user can select the amount of heat transfer fluid which is cooled, and correspondingly control a rate at which heat is drawn from the wearer and delivered to the heat sink.

The heat sink material, preferably in the form of the drinkable fluid such as water, is contained within a cartridge which can be removed from a pouch in the backpack, such as when it has been depleted. A new cartridge can then be placed into the backpack so that cooling of the heat transfer fluid can continue. In this way, the wearer can maintain adequate temperature control for long periods of time without being required to carry a large cartridge of heat sink material.

The garment through which the heat transfer fluid flows to draw heat from the wearer preferably is configured as a pair of layers spaced apart by a heat transfer fluid space. A plurality of dots connect the two layers together. These dots help to maintain a generally planar form of the garment and assist in mixing of the heat transfer fluid for maintenance of a uniform temperature for the heat transfer fluid.

Fences are also preferably provided extending between the inner and outer layers of the garment. These fences divide the heat transfer space into pathways so that the heat transfer fluid can be effectively routed without pockets of stagnation, and so that the heat transfer fluid most effectively draws heat away from the wearer and flows to the heat sink for cooling of the heat transfer fluid. These garments can particularly be configured as a vest portion, a cap portion, or other portions, depending on the particular performance needs for the garment.

Optionally, elevated pressure air can be provided to enhance surface contact between the heat transfer fluid pathway and the heat sink, and between the garment and the wearer so that rates of heat transfer can be maximized. Pumps and associated power supplies are included in a backpack with the heat sink material cartridge to power circulation of the heat transfer fluid and optionally compressed air to facilitate fluid flow according to this invention.

OBJECTS OF THE INVENTION

Accordingly, a primary object of the present invention is to provide a system for both cooling and hydrating an individual operating within a high temperature environment.

Another object of the present invention is to provide a cooling and hydration system which is wearable by the user.

Another object of the present invention is to provide a system to facilitate optimal functioning of a human within exceptionally high temperature environments, such as deserts.

Another object of the present invention is to provide a wearable cooling and hydration system which can be quickly and easily recharged when depleted.

Another object of the present invention is to provide a cooling and hydration system which can be worn by a user in a convenient fashion which avoids interfering with the functions being preformed by the wearer.

Another object of the present invention is to provide a cooling and hydration system suitable for use by armed services personnel while conducting operations in high temperature environments, such as deserts and jungles.

Another object of the present invention is to provide a cooling and hydration system which cools both a head and torso of the wearer.

Another object of the present invention is to provide a cooling and hydration system which is controllable by a user for maximum comfort.

Another object of the present invention is to provide a cooling and hydration system which can operate in contaminated environments with minimum contamination of the system, and particularly drinking water within the system.

Another object of the present invention is to provide a cooling and hydration system which is adapted for use by athletes and other individuals undergoing rigorous exercise or exercise in high temperature environments.

Another object of the present invention is to provide a cooling and hydration system for use by laborers who are required or benefit from the ability to work in high temperature environments with a high degree of capability.

Another object of the present invention is to provide a cooling and hydration system for use by a wearer who suffers from a medical condition where cooling of the body provides a therapeutic effect, such as multiple sclerosis.

Another object of the present invention is to provide a cooling and hydration system which can either be entirely worn by the user or can be divided into two parts with a portion providing heat transfer from the body of the wearer being worn, and with a heat sink portion being either wearable or carryable by the user or upon some load carrying vehicle, or resting on the ground adjacent the individual to be cooled, when the individual is working at a single location or within sufficiently close proximity to a single location that conduits can pass from the heat sink portion to the individual being cooled.

Other further objects of the present invention will become apparent from a careful reading of the included drawing figures, the claims and detailed description of the invention.

DESCRIPTION OF THE PREFERRED EMBODIMENT

Figures 1, 2, 3:
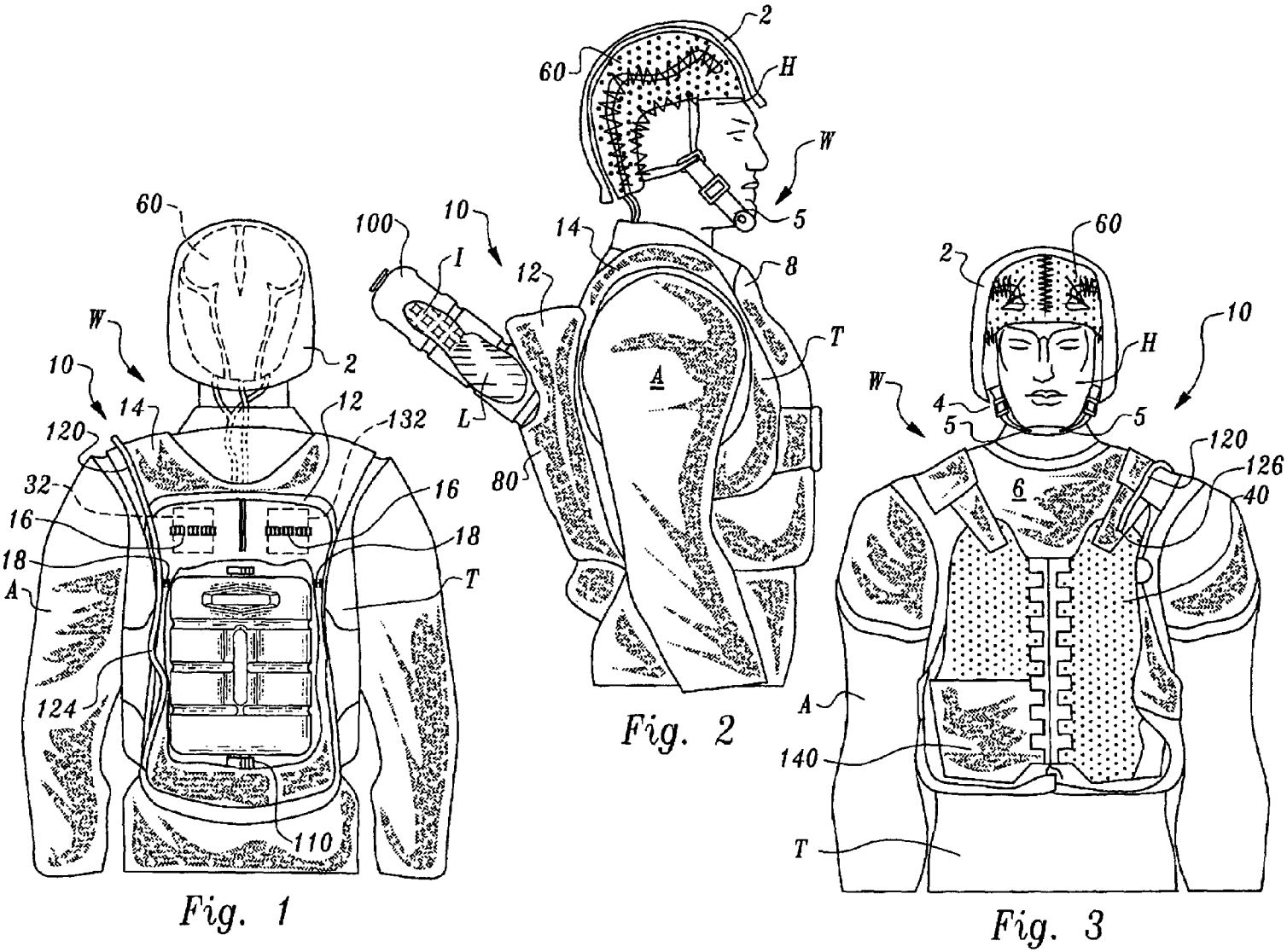
FIG. 1 is a rear elevation view of the system of this invention while being worn by a wearer and with portions of a backpack bearing the system cut away to reveal interior details thereof, and with portions of the system shown in broken lines.
FIG. 2 is a side elevation view of that which is shown in FIG. 1 and with a cartridge containing the heat sink material shown partially removed from a backpack portion of the invention, and with portions of a helmet of a wearer cutaway to reveal details of the cap for cooling the head of the wearer.
FIG. 3 is a front elevation view of that which is shown in FIGS. 1 and 2, and with portions cut away to reveal details of the vest, cap, and cummerbund according to this invention.

Referring to the drawings, wherein like reference numerals represent like parts throughout the various drawing figures, reference numeral 10 is directed to the cooling and hydration system of this invention (FIGS. 1 through 4). With this system 10, the wearer W has both the wearer's body cooled to maintain comfort and optimal performance, as well as being provided with a source of hydration for the wearer W. The wearer W can thus maintain optimal performance even in exceptionally high temperature environments, such as deserts or tropical environments.

Figure 4:
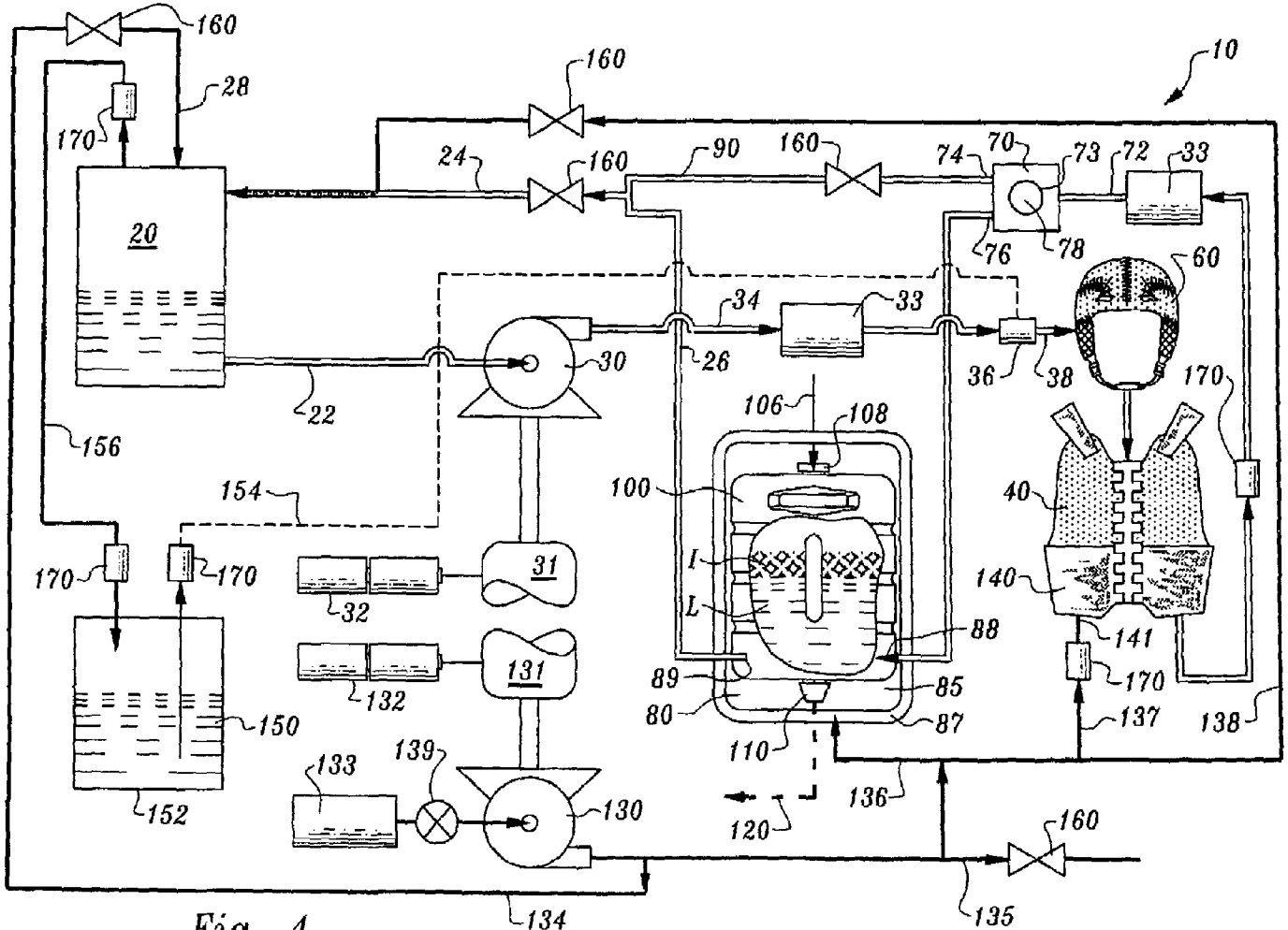
FIG. 4 is a schematic of the overall cooling and hydration system showing the flow pathways and associations between the components of the system of this invention.

In its essence, and with particular reference to FIG. 4, details of the operation of the overall system of this invention are described. The system 10 includes a heat transfer fluid with begins within a reservoir 20. A heat transfer fluid pump 30 draws the heat transfer fluid out of the reservoir 20 and delivers it to a garment worn by the wearer W (FIG. 1). This garment typically and preferably includes both a vest 40 and a cap 60. Within the vest 40 and cap 60 the heat transfer fluid heats up as it draws heat away from the body of the wearer W through the vest 40 and cap 60. The wearer W is thus cooled a corresponding amount.

The heated heat transfer fluid then passes to a temperature control valve 70. The temperature control valve 70 selectively directs a portion of the heat transfer fluid along a cold path to a heat exchange pouch 80 for cooling and a portion along a hot path bypass line 90 for return back to the reservoir 20 without cooling. The heat transfer fluid which is directed from the temperature control valve 70 to the heat exchange pouch 80 passes adjacent a cartridge 100 filled with a heat sink material, preferably of initially water ice I. The heat transfer fluid thus gives up its heat to the ice I, causing the ice to melt into liquid water L, and cooling the heat transfer fluid before it returns back to the reservoir 20. When the heat transfer fluid again leaves the reservoir 20 it has been cooled and so is capable of further cooling of the wearer W when re-circulating back to the vest 40 and cap 60. As the water L within the cartridge 100 melts, its passes through the water outlet valve 110 and is available for drinking from the drinking tube 120.

An air pump 130 is optionally provided which can deliver air to the heat exchange pouch 80 to maximize contact and heat transfer between the heat transfer fluid and the heat sink material within the cartridge 100, and can also optionally be fed to a cummerbund 140 to apply pressure against the vest 40 to maximize heat transfer between the torso T of the wearer W and the vest 40.

The system 10 preferably includes a heat transfer filler source 150 which can be initially provided and periodically provided thereafter to charge or recharge the system with heat transfer fluid. Various check valves 160 maintain fluid flow and air flow in the desired directions. Various miscellaneous disconnects 170 are provided within the system 10 at locations where the system 10 requires frequent separation, such as when the backpack 12 (FIG. 1) including the cartridge 100 and pumps 30, 130 need to be removed, but the wearer wishes to keep the vest 40 and cap 60 on.

Figure 18:
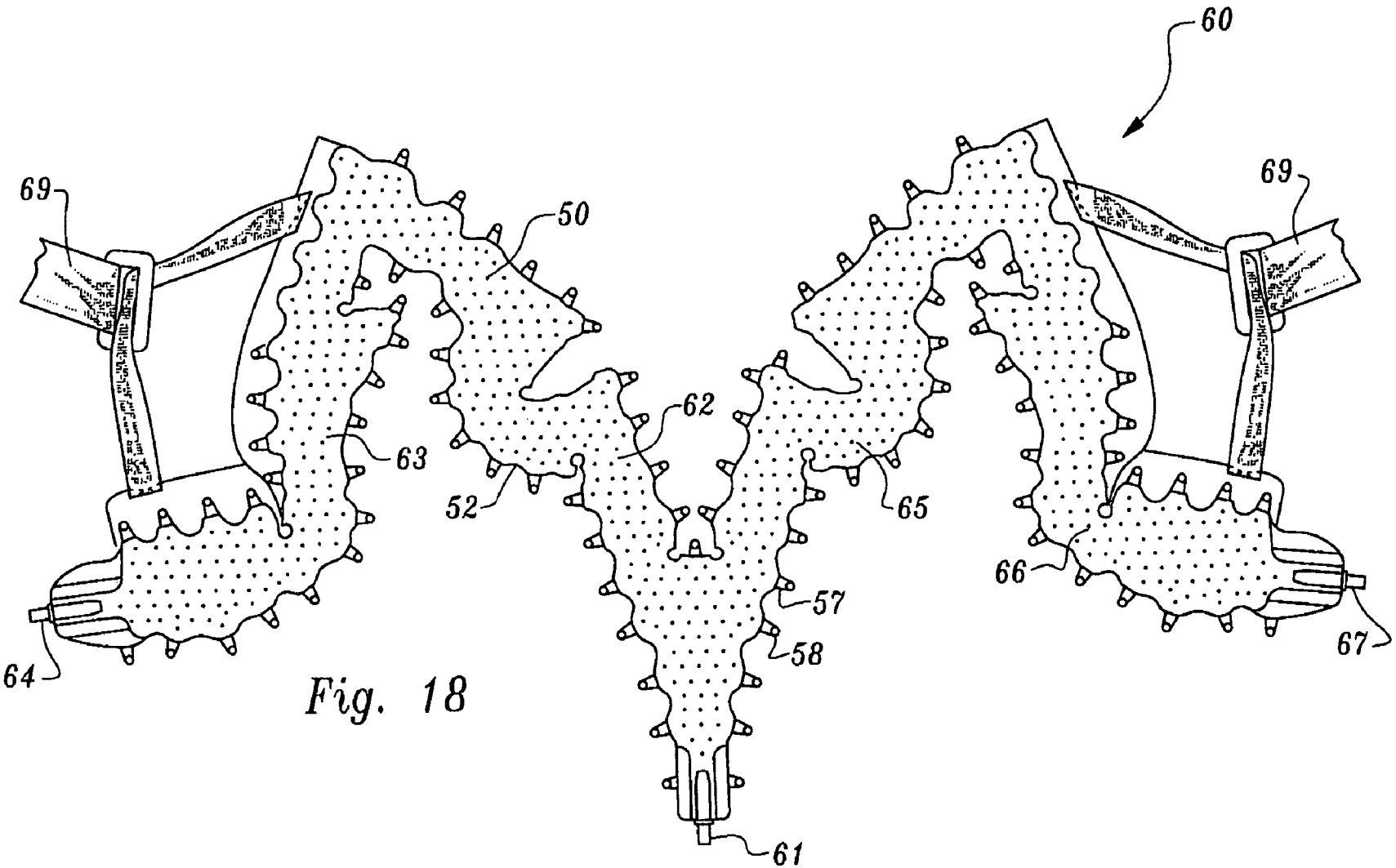
FIG. 18 is a top plan view of the cap of this invention laid flat and entirely unlaced, and with an outer layer removed to reveal a preferred dot pattern and pathway configuration for the cap of this invention.

More specifically, and with particular reference to FIGS. 1 through 3, the general features of this invention are further shown in particular relationship with the body of the wearer W utilizing the system 10. The wearer W would typically be a human individual with head H, arms A and torso T. In the particular embodiment depicted, the wearer W is generally equipped as a soldier and including a helmet 2 adapted to overlie the cap 60. The helmet 2 includes straps 4 for securing under a chin of the head H. Most preferably, snaps 5 are provided on a chin strap portion of the cap 60 with the snaps 5 available for connecting to the straps 4 of the helmet 2. In this way, the straps 4 of the helmet 2 do not need to also pass under the chin of the wearer W, but merely attach to the ear covers with chin straps 69 of the cap 60 (FIG. 18).

The wearer W would typically wear an undershirt 6 underneath all of the different portions of the system 10. The vest 40 and optional cummerbund 140 would then be placed on the wearer W overlying the undershirt 6, and beneath an over shirt 8. Portions of the system 10 such as the drinking tube 120 would be preferably integrated with the straps 4 of the backpack 12 and be located primarily on an exterior of the over shirt 8.

Figure 6:
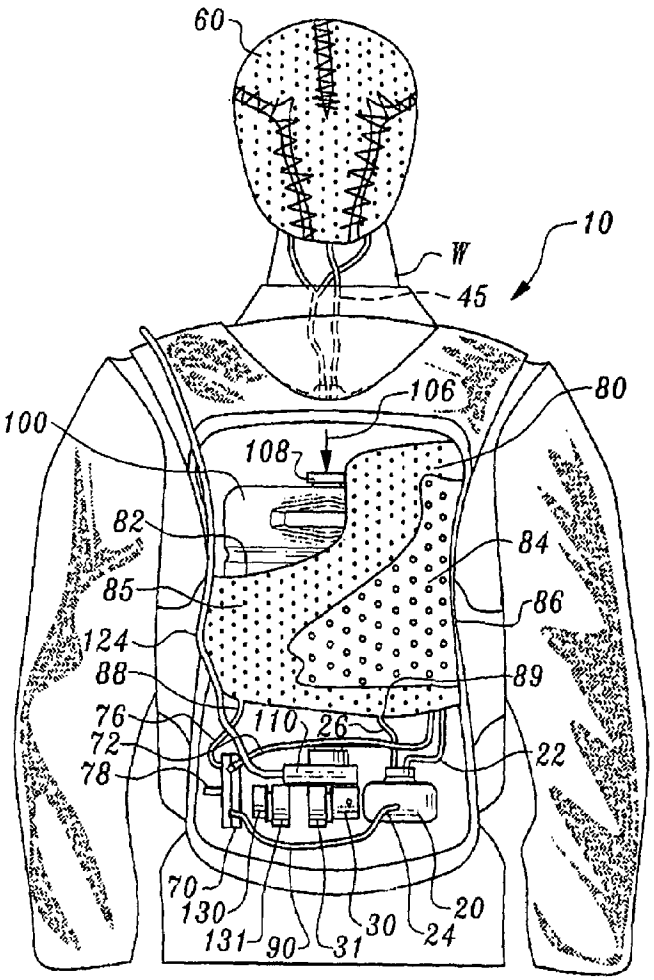
FIG. 6 is a rear elevation view similar to that which is shown in FIG. 5, but with less of the system cutaway, such that portions of the heat sink cartridge and portions of a pouch in which the heat sink cartridge resides are shown, as well as heat transfer fluid handling equipment according to the system of this invention.
Figure 9:
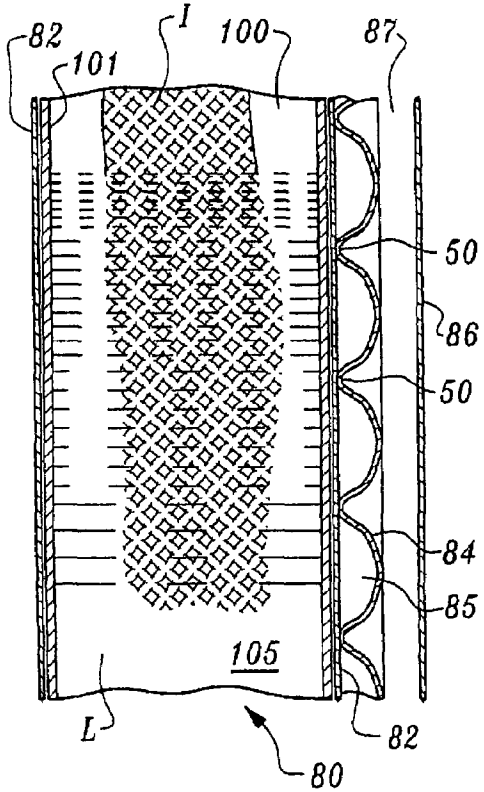
FIG. 9 is a side partial section of the cartridge of this invention as well as portions of the pouch and backpack surrounding the cartridge.
Figure 8:
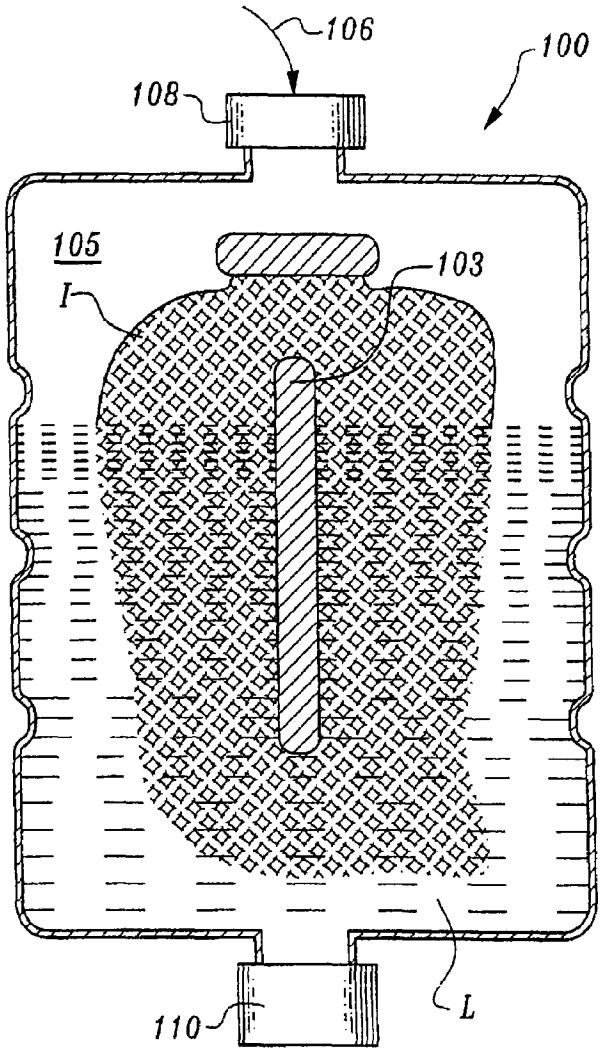
FIG. 8 is a full sectional view of that which is shown in FIG. 7, and revealing that the heat sink material is in a partially liquid and partially solid (ice) state.
Figure 7:
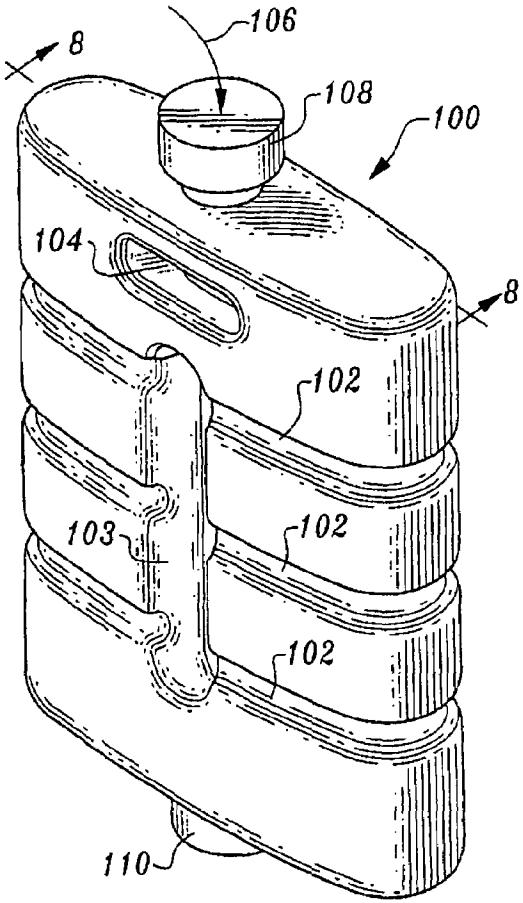
FIG. 7 is a perspective view of the heat sink material cartridge of this invention.

The remaining portions of the system are preferably configured within a backpack 12 which is worn on an exterior of the over shirt 8 and overlying a back of the wearer W. The backpack 12 includes straps 14 riding over shoulders of the wearer W. Generally, the backpack 12 includes a pair of top zippers 16 which allow access to compartments for batteries 32, 132 to power the heat exchange fluid pump 30 and air pump 130. The backpack 12 additional includes a large zipper 18 providing access into the heat exchange pouch 80 (FIGS. 6 and 9). This pouch 80 is adapted to receive the cartridge 100 in a removable fashion therein. In this way, the entire system 10 can be recharged by swapping out one cartridge 100 for another without requiring any connecting or disconnecting of conduits, wires or other structures.

Figure 5:
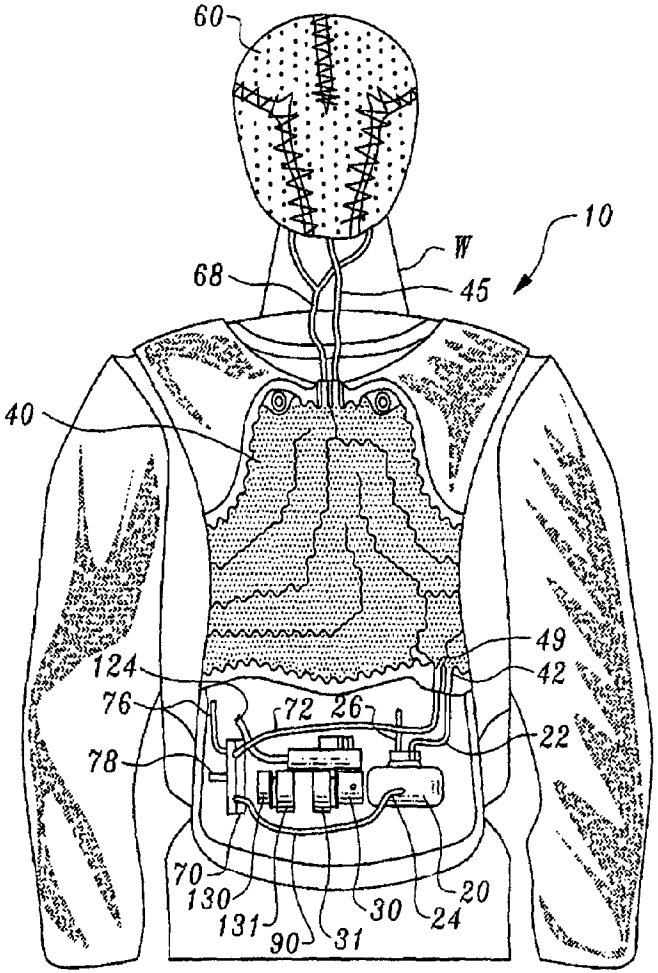
FIG. 5 is a rear elevation view of this invention with portions of the backpack cut away and to reveal details of the vest and heat transfer fluid handling equipment.

With particular reference to FIGS. 4 through 6 details of the heat transfer fluid reservoir 20 are described, according to a preferred embodiment of this invention. The reservoir 20 provides the location where excess heat transfer fluid is contained before passing through the heat transfer fluid pathways, passing through various portions of the vest 40 and heat exchange pouch 80 according to this invention. The reservoir 20 is preferably in the form of an enclosure which is carried within the backpack 12 (FIGS. 1 through 3) with the reservoir 20 most preferably at a lower right portion of the backpack 12 as depicted especially in FIGS. 5 and 6. The reservoir 20 can have any of a variety of different shapes and can either be a stand alone enclosure, or can be closely integrated with adjacent elements of the system 10.

In general, and with reference to FIG. 4, the reservoir 20 includes an outlet 22 for delivery of heat transfer fluid out of the reservoir 20. With reference to FIGS. 5 and 6, the reservoir 20 can be provided with both a bypass return 24 and a pouch return 26. The bypass return 24 delivers heat transfer fluid directly back from the vest 40 and cap 60 through the temperature control valve 70, and without cooling through the heat exchange pouch 80. The pouch return 26, in contrast, returns from the heat exchange pouch 80 where it has given up significant heat to the heat sink material within the cartridge 100, such that the heat transfer fluid from the pouch return 26 is significantly cooler than the heat transfer fluid passing through the bypass return 24 and back into the reservoir 20. These returns 24, 26 can join together outside of the reservoir 20 (FIG. 4) or re-enter the reservoir 20 along separate lines (FIGS. 5 and 6).

Most preferably, the reservoir 20 includes an air inlet 28 coupled to the air pump 130 through a prime line 134. By delivering compressed air into the reservoir 20, a slight pressure greater than atmospheric pressure is provided within the reservoir 20 to assist in priming the heat transfer fluid pump 30 and otherwise distributing heat transfer fluid out of the reservoir 20 and into the various heat transfer fluid pathways provided within the system 10. Such air pressure augmentation is optional, but is included in a preferred embodiment of this invention.

With continuing reference to FIGS. 4 through 6, details of the heat transfer fluid pump of this invention are described, according to a preferred embodiment. For proper operation of the system 10, it is important that the heat transfer fluid move along the heat transfer fluid pathways which generally form a circuit extending out of the reservoir 20 and back to the reservoir 20 after passing through the vest 40, cap 60, and optionally either through the heat exchange pouch 80, or the bypass line 90 before returning back to the reservoir 20. The pump 30 acts as the prime mover to circulate the heat transfer fluid along this heat transfer fluid pathway.

The pump 30 is preferably driven by a motor 31 which is powered by batteries 32 (FIG. 1) contained within the small compartments in an upper portion of the backpack 12. Most preferably the pump 30 requires 6 volts and can be adequately powered by four 1.5 volt batteries, such as "D" cell batteries oriented in series. Motors 31 having different power needs can be powered by different battery arrangements depending upon the particular specifications of the motor 31 actually utilized.

Preferably a pair of filters are strategically located as shown along the heat transfer fluid pathway to remove debris to protect the pump 30 such that any particulates within the heat transfer fluid are removed before passing through the pump 30. The pump 30 then delivers elevated pressure fluid to the supply line 34 (FIG. 4). This supply line 34 extends to disconnect 36 before entering a garment inlet 38 leading to some portion of garment of the system 10, such as the vest 40 or cap 60. Most preferably this garment inlet 38 is the first fluid inlet 42 of the vest 40 (FIG. 5). Alternatively, the garment inlet 38 can be any form of garment adapted to receive heat transfer fluid for cooling of the wearer W.

In the depiction of this invention shown in FIGS. 5 and 6, the pump 30 is shown adjacent the reservoir 20 rather than in line with the outlet 22 of the fluid reservoir 20 leading to the first fluid inlet 42 of the vest 40. This depiction shown in FIGS. 5 and 6 provides the general relationship of the various different components of this invention, with the most precise heat transfer fluid routing most accurately shown in FIG. 4. The pump 30 can be integrated with the reservoir 20 so that at least an impeller portion of the pump 30 extends into the reservoir 20 and with the filter 33 located within the reservoir 20 such that the supply line 34 downstream from the pump 30 can be the same as the outlet 22 from the fluid reservoir 20 depicted in FIGS. 5 and 6. The electric wiring showing delivery of electric current from the batteries 32 (FIG. 1) to the motor 31 (FIGS. 5 and 6) is not shown to enhance clarity of the features that are shown in FIGS. 5 and 6.

Mpst preferably, the motor 31 and pump 30 are configured to minimize the possibility of motor 31 or pump 30 damage if the system 10 is not operating properly. As an example, the motor preferably includes a safety shut off system that shuts off the motor 31 and pump 30 if the motor is drawing too much current for an extended period of time. For instance, if the pump 30 is cavitating, or one of the lines in the heat transfer fluid pathway is crimped, or otherwise blocked, the motor 31 might cavitate or run in a dry state, potentially running the motor 31 too fast and/or the pump running without proper lubrication, and damaging the motor 31 or pump 30. When such high current draw conditions are maintained for a pre-set amount of time (i.e. 30 seconds), the safety system shuts off the motor 31.

The disconnect 36 is provided along the supply line 34 and before the garment inlet 38 so that the backpack 12 and associated equipment such as the pump 30 can be removed while portions of the garment, such as the vest 40 and cap 60, can continue to be worn. This facilitates swapping out of equipment, solo resupply of fresh cartridges 100, repair of equipment located within the backpack 12, and mere removal of the backpack 12 when the individual is entering an environment where less heat stress is likely and it is desirable that the wearer W bear less weight. The disconnects 36, 170 are configured to release merely by tension pulling thereon, such that disconnection is simplified, especially for rapid removal of the backpack 12.

With particular reference to FIGS. 13 through 16 and 19 through 21, particular details of the vest 40 of this invention are described, according to a preferred embodiment. The vest 40 provides one portion of a preferred form of garment for causing heat transfer out of the body of the wearer W and into the heat transfer fluid for delivery to the heat sink, such as the cartridge 100 and heat sink material contained within the cartridge 100, such as water L/ice I. Other forms of garments could be provided in addition to the vest 40 or in replacement of the vest 40.

Most preferably, the vest 40 is not merely a single large compartment. Rather, the vest 40 is divided into an elongate pathway along which the heat transfer fluid passes while passing through the vest 40. As particularly depicted in FIG. 16, the vest 40 preferably includes a first fluid inlet 42 where the heat transfer fluid first enters the vest 40. A rising path 43 is provided extending up from the first fluid inlet 42 around a perimeter of the vest 40 and to the first fluid outlet 44. This rising path 43 is primarily provided to most conveniently deliver the heat transfer fluid up to the cap 60. It is typically preferable to cool the head H of the wearer W, such as through the cap 60, before providing heat transfer out of the wearer W through the vest 40. Thus, this rising path 33 passes relatively directly from the first fluid inlet 42 to the first fluid outlet 44. A cap supply tube 45 then takes the heat transfer fluid from the first fluid outlet 44 up to the cap 60.

When the heat transfer fluid is returning from the cap 60, the vest 40 is adapted to again receive the heat transfer fluid at a second inlet 46 feeding a first falling path 47 and second falling path 48 within the vest 40. These paths 47, 48 are generally parallel to each other as they wind down from the second inlet 46 to a second outlet 49 at a bottom of the vest 40. A bulk of the vest 40 is comprised of the paths 47, 48, where a bulk of heat transfer out of the torso T of the wearer W occurs.

The particular orientation of the paths 43, 47, 48 can be adjusted as desired. In general, making the paths 43, 47, 48 narrower increases the friction losses as the heat transfer fluid passes through the vest 40, but minimizes any stagnation pockets along the paths 43, 47, 48 where heat transfer fluid might stop moving or move more slowly than other portions of the heat transfer fluid. The size of the vest 40, and the constitution of the heat transfer fluid, as well as the power of the pump 30 are all factors which bear on how best to configure the paths 43, 47, 48 within the vest 40. A most preferred form of heat transfer fluid currently contemplated is a 50/50 mix of propylene glycol and water with 0.25% of a wetting agent and an iodine tincture.

Figure 16:
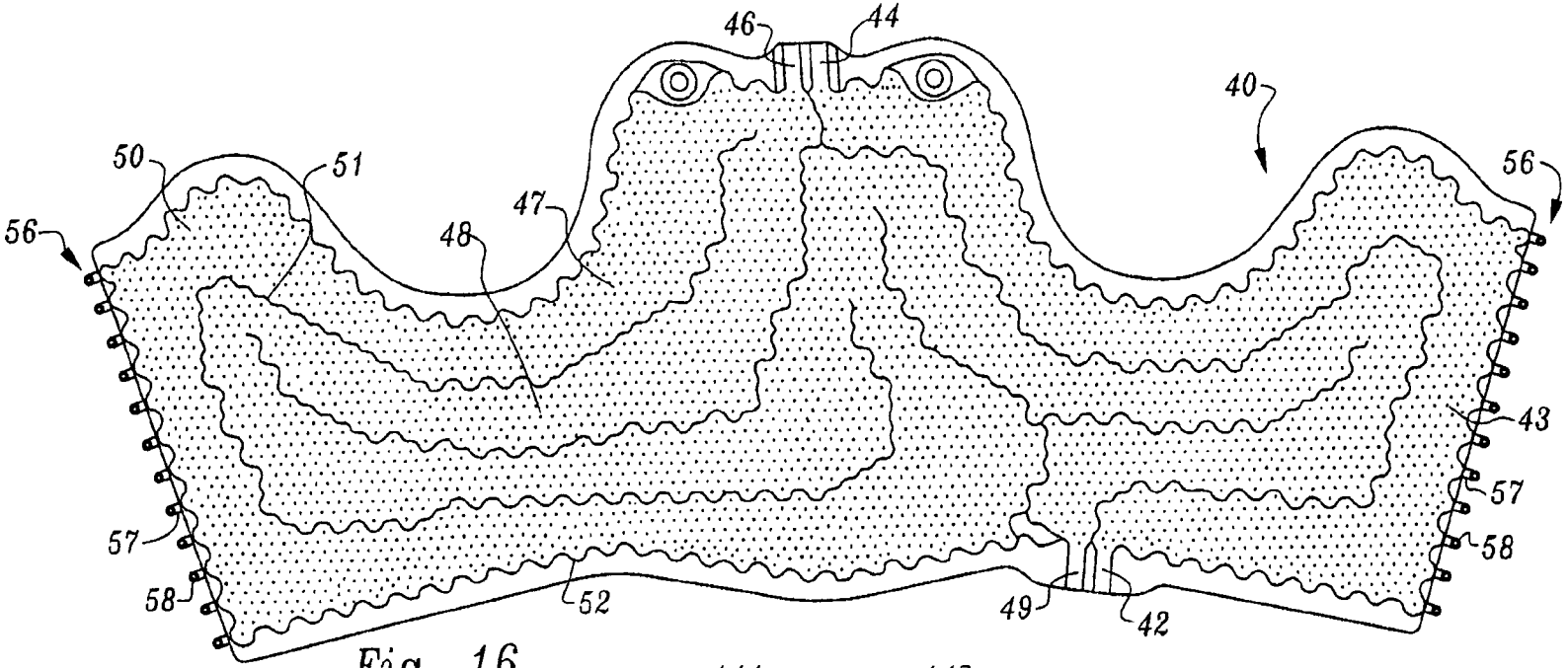
FIG. 16 is a top plan view of the vest of this invention shown off of the wearer and laid flat, and with an outer layer thereof removed to reveal interior pathways, fences and dots within the vest.
Figure 17:
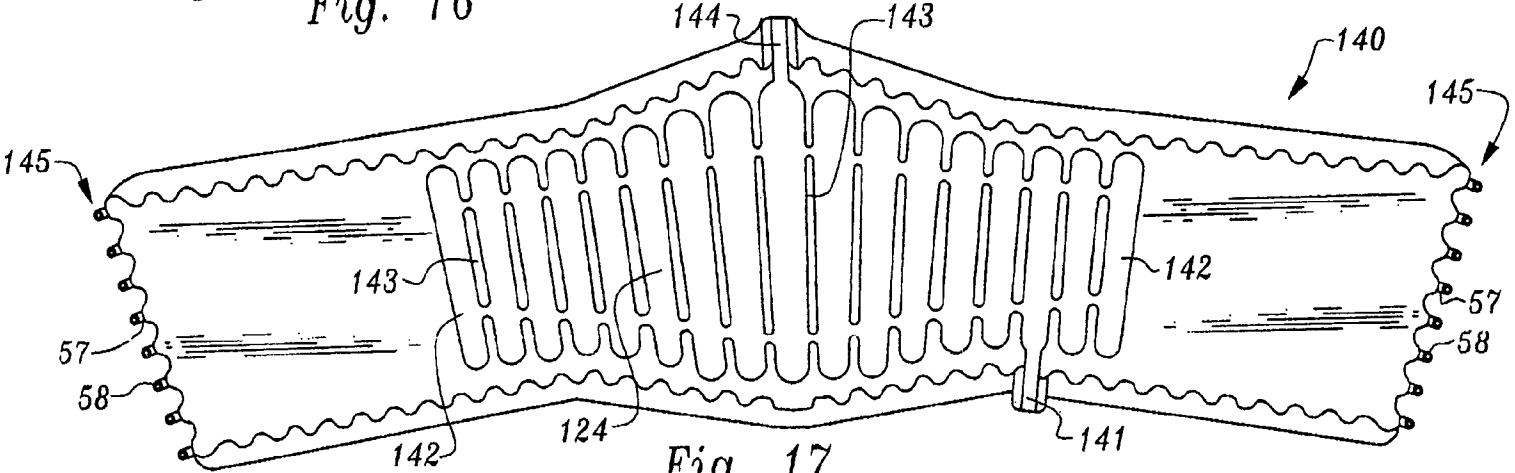
FIG. 17 is a top plan view of the cummerbund of this invention with an outermost layer removed to reveal interior details thereof.
Figure 20:
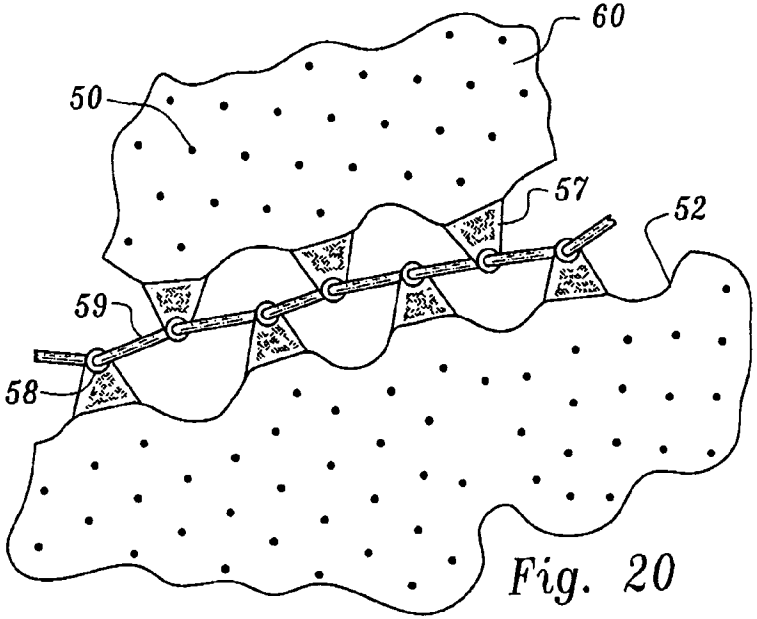
FIG. 20 is a detail of a portion of a seam between adjacent pathways on the cap of this invention and revealing in detail how seams within the cap of this invention are drawn closed.
Figure 21:
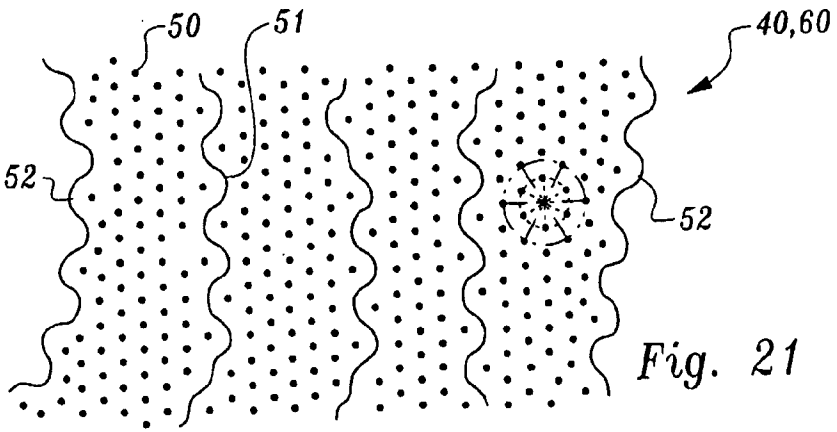
FIG. 21 is a detail of a portion of the vest or cap of this invention particularly revealing how the dots and fences or borders are arranged according to this invention.
Figure 19:
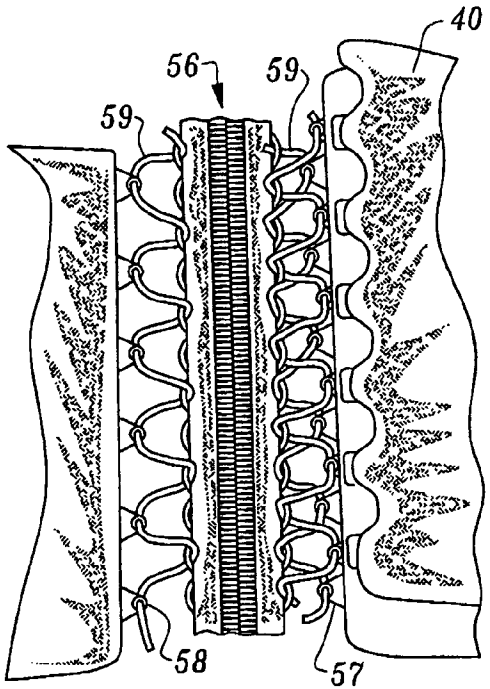
FIG. 19 is a detail of a portion of the vest of this invention as well as a sternum joint, revealing in detail how the vest is secured to the wearer.

With particular reference to FIGS. 20 and 21, particular additional details of the vest 40 are described. In particular, the vest 40 is generally in the form of an inner layer and an outer layer which are generally parallel to each other with a heat transfer fluid space between these two layers. In FIGS. 16, 20, and 21 an outer layer has been removed so that interior details of the vest 40 including the orientation of the paths 43, 47, 48, can be shown.

A border 52 defines an ultimate perimeter of the vest 40 where these inner and outer layers are bonded together so that the heat transfer fluid space between the inner layer and the outer layer is entirely enclosed, except where the fluid inlets 42, 46 and fluid outlets 44, 49 are provided.

Most preferably, the vest 40 is configured with a plurality of dots 50 extending between the inner layer and the outer layer. These dots 50 are preferably formed by radio frequency welding the inner layer and outer layer formed of plastic material together. These dots 50 help to maintain a relatively constant thickness of the vest 40 between the inner layer and the outer layer. Also, the dots 50 encourage mixing of the heat transfer fluid as it passes along the various different paths within the vest 40.

The dots 50 are preferably substantially round, but could be square, rectangular or exhibit other faceted or curved forms, being primarily non-elongate, but rather mostly residing near a central point. The dots 50 are preferably substantially uniformly spaced from each other and occupy a generally hexagonal pattern with the dots 50 adjacent a central dot 50 spaced about sixty degrees from each other. The dot 50 spacing is most preferably 0.32 inches, and configured to cause the inner layer and outer layer of the vest 40 to be spaced <0.10 inches from each other. The dot spacing is preferably optimized to account for various parameters including the peel strength of the material, the operating pressure of the fluid in the garment, the weight and volume of the heat transfer fluid, the skin thermal conductance, and the ratio of dot area to conductance area. In some instances, these parameters can dictate dot 50 spacing of 0.30 inches or less or 0.35 inches or more. The vest 40 layer spacing can conceivably increase in some instances to 0.15 inches or even 0.20 inches or more under some conditions.

Additionally, fences 51 are provided extending between the inner layer and the outer layer. These fences 51 cause the heat transfer fluid space within the vest 40 to be broken into the heat transfer fluid pathway extending between the inlets 42, 46 and the outlets 44, 49. The fences 51 preferably are aligned with the dots 50 such that no dots 50 are close to the fences 51, but so that the fences 51 are either generally a maximum distance away from the dots 50 or intersect the dots 50. Following such criteria, the fences 51 have a generally highly irregular serpentine configuration. The fences 51 are similarly formed by bonding the inner layer and the outer layer together, such as by radio frequency radiation bonding together.

Additionally, the vest 40 preferably includes shoulder straps 55 (FIGS. 13 through 16) to assist in holding the vest 40 where desired adjacent the torso T of the wearer W. A sternum joint 56 is provided to join two of the borders 52 of the vest 40 together so that the vest 40 can entirely gird the torso T of the wearer W. This sternum joint 56 preferably includes a plurality of tabs 57 with eyelets 58 in each of the tabs 57. Laces 59 are added through the eyelets 58 and each of tabs 57 so that tightening of the laces 59 cause the vest 40 to be tightened. If required, the sternum joint 56 can include an intermediate structure, generally in the form of a spacer (FIG. 19), so that a length of the laces 59 can be minimized and the sizing of the vest 40 can be varied. The vest 40 would typically preferably be provided in different sizes to accommodate wearers W of different sizes, and yet be somewhat adjustable.

With particular reference to FIGS. 13 through 15, 18, 20, and 21, particular details of the cap 60 are described, according to a preferred embodiment. The cap 60 provides a heat transfer garment which is particularly configured to remove heat from the head H of the wearer W and into the heat transfer fluid for cooling of the head H of the wearer W. The cap 60 preferably includes layering and dots 50 similar to those described above with regards to the vest 40. However, the cap 60 preferably does not include fences 51, but rather relies on having an elongate shape defined by borders 52.

In particular, the cap 60 preferably includes an inlet 61 which is adapted to be coupled to the cap 60 supply tube 45. Heat transfer fluid pathways within the cap 60 include a left forward path 62 which extends from a base of the skull of the head H of the wearer W when the cap 60 is on the head H of the wearer W toward a crown of the head H. After reaching the crown, the left forward path 62 transitions into a left return path 63 which generally curves around the left ear on the head H of the wearer W and terminates at a left outlet 64 on a left side of the base of the head H, adjacent the inlet 61.

Similarly, a right forward path 65 is provided extending forward and then connecting to a right return path 66 which extends back to a right outlet 67. The right forward path 65, right return path 66 and right outlet 67 are preferably substantially mirror images of the left forward path 62, left return path 63 and left outlet 64.

Figure 15:
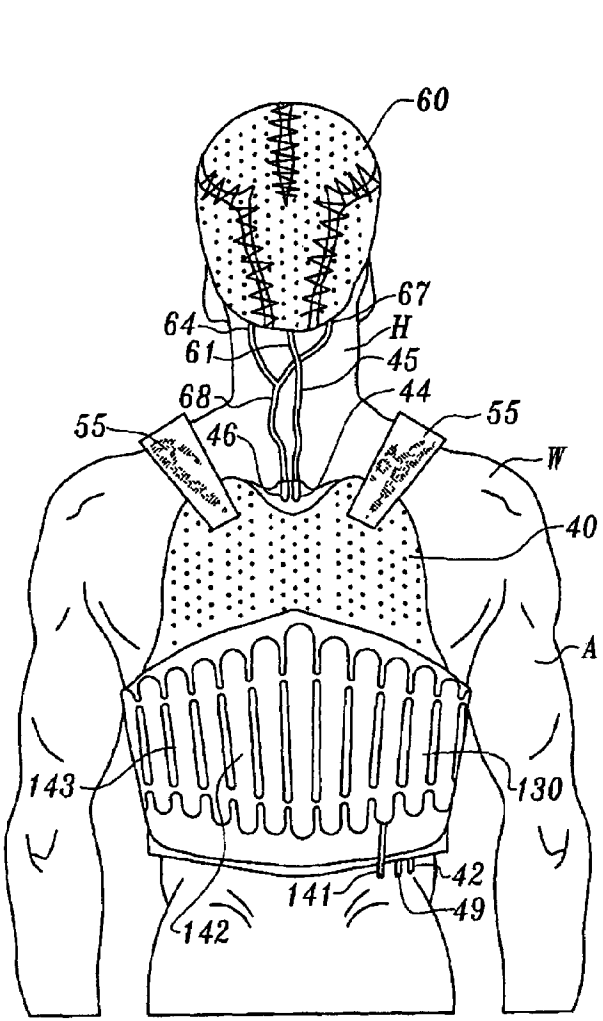
FIG. 15 is a rear elevation view of that which is shown in FIG. 13.
Figure 14:
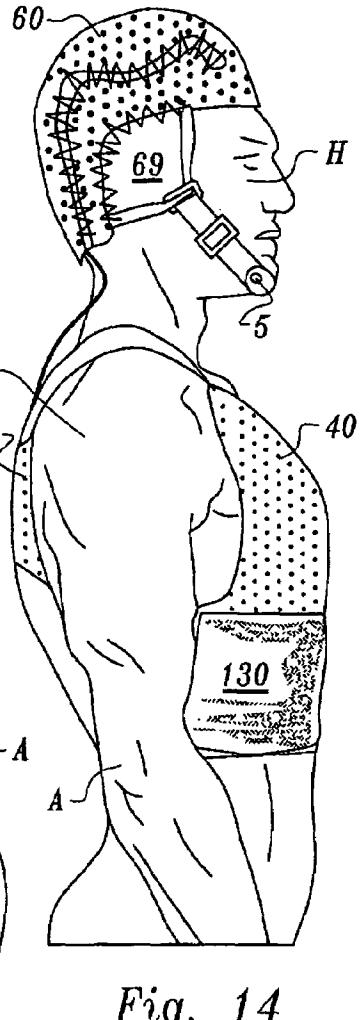
FIG. 14 is a side elevation view of that which is shown in FIG. 13.
Figure 13:
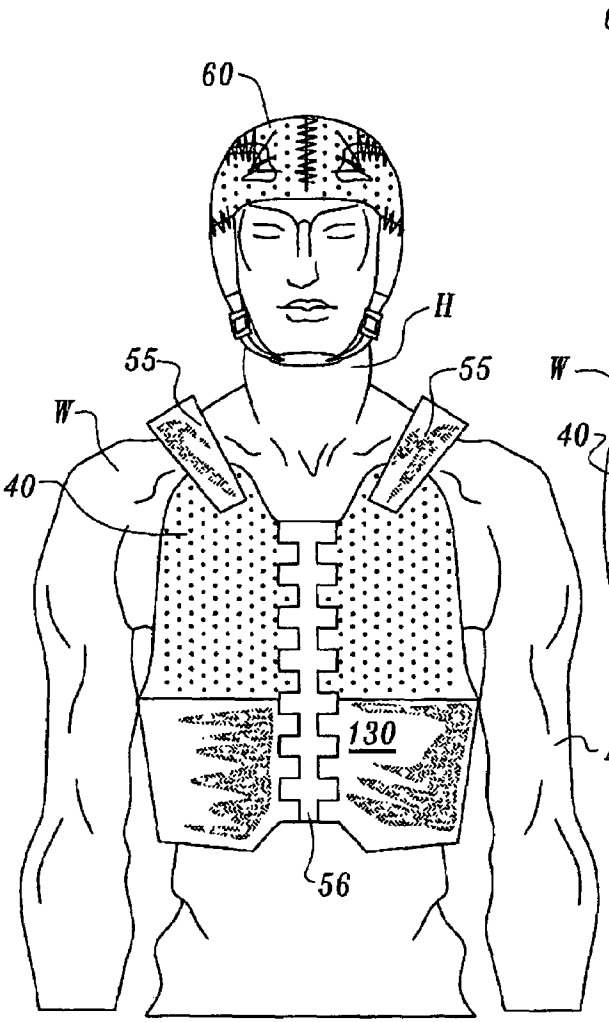
FIG. 13 is a front elevation view of the vest and cap portions of this invention alone upon the wearer.

Tabs, eyelets and laces are preferably provided similar to those described above with regard to the vest 40, so that the paths 62, 63, 65, 66 of the cap 60 can be drawn tightly together and so that these paths 62, 63, 65, 66 take on a generally spherical form adapted to fit snugly over the head H of the wearer W (FIGS. 13 through 15). The left outlet 64 and right outlet 67 feed into a "Y" tube 68 where fluid flow from these two outlets 64, 67 join together before the fluid is directed to the second inlet 46 at an upper portion of the vest 40.

Most preferably, ear covers 69 are also provided with tabs and eyelets so that they can be laced to the cap 60 and assist in securing the cap 60 securely to the head H of the wearer W. These ear covers with chin straps 69 extend under the chin of the wearer W and provide a location for snaps 5 on strap 4 of the helmet 2 to connect, when the helmet 2 is to be worn over the cap 60 (FIGS. 2 and 3). Particular detail regarding how the laces 59 are utilized along with the tabs 57 and eyelets 58 are shown in detail in FIG. 20.

With particular reference to FIGS. 4 through 6 details of the temperature control valve 70 are described, according to a preferred embodiment. After the heat transfer fluid exits the second outlet 49 of the vest 40, the heat transfer fluid has drawn heat from the wearer W and so a temperature of the heat transfer fluid has been increased to a point where it can typically no longer effectively draw additional heat from the wearer W.

It is thus important that this heat transfer fluid be cooled before re-circulating back to the vest 40, cap 60, or other heat transfer garment. On the other hand, if the heat transfer fluid is too effectively cooled, the heat transfer fluid can be re-circulated to the vest 40, cap 60 or other heat transfer garment at too cool of a temperature and cause the wearer W to experience an uncomfortably too cool temperature. Accordingly, it is desirable according to a preferred embodiment to have a temperature control valve through which the wearer W can control a temperature of the heat transfer fluid and thus a rate at which heat is removed from the wearer W. Alternatively, this temperature control valve 70 can be thermostatically controlled, such as with a temperature sensor in the heat transfer fluid and with the temperature control valve 70 adjusted based on the temperature reading received by this temperature sensor.

The temperature control valve 70 includes an input 72 receiving the elevated temperature heat transfer fluid from the vest 40 or other garment. The input 72 then leads to a flow splitter 73 within the temperature control valve 70. The flow splitter 73 acts as a divider to divide the flow between a bypass outlet 74 and a cooling outlet 76. A controller 78, such as a dial is provided to adjust the flow splitter 73 and adjust a proportion of the heat transfer fluid which is directed to the bypass outlet 74 and to the cooling outlet 76.

The bypass outlet 74 leads to a hot path and the cooling outlet 76 leads to a cold path for the heat transfer fluid. The hot path connects to the bypass line 90 and returns directly to the reservoir 20 without cooling. The cold path extends to the heat exchange pouch 80 where the heat transfer fluid is cooled before returning to the reservoir 20. Thus, when a greater amount of the heat transfer fluid is directed to the cold path and the heat exchange pouch 80 by adjusting of the temperature control valve 70, the heat transfer fluid is cooled to a greater extent before returning back to the vest 40 and the cap 60 or other heat exchange garment, for an increased amount of cooling of the wearer W. When a greater amount of the heat transfer fluid is passed through the bypass outlet 74 to the bypass line 90, the heat transfer fluid is cooled to a lesser extent so that when it is returned to the vest 40, cap 60 or other heat transfer garment, the wearer W receives a lesser degree of cooling.

As depicted in FIGS. 5 and 6, the temperature control valve 70 is shown at a lower rear left side of the backpack 12 (FIG. 1). However, this position for the temperature control valve 70 could be altered, such as by rotating further to the side of the wearer W so that the wearer W can see the temperature control valve 70 while adjustment takes place. Typically, the dial or other controller 78 extends out of the backpack 12 to facilitate manual adjustment by the wearer. Indicia can be printed adjacent this dial 78 and the dial 78 can be fitted with detents so that a user can most conveniently tell what setting is currently selected for the valve 70.

With particular reference to FIGS. 4 through 6 and 9, details of the heat exchange pouch 80 are described, according to a preferred embodiment. The heat exchange pouch 80 provides a region where the heat exchange fluid can be brought into close proximity with the cartridge 100 so that heat transfer can occur from the heat transfer fluid to the heat sink material, such as ice I or liquid water L within the cartridge 100.

The heat exchange pouch 80 (FIG. 6) generally has a configuration somewhat similar to that of the vest 40. In particular, the heat exchange pouch 80 includes an inside layer 82 generally parallel with a mid-layer 84, under which a heat transfer fluid space 85 between the layers 82, 84 resides. Preferably, dots, such as the dots 50 of the vest 40 (FIG. 21) are provided joining the inside layer 82 and mid layer 84 together.

The inside layer 82 is oriented to come into direct contact with the cartridge 100. The layers 82, 84 are sealed together at peripheral borders thereof, except where inlets and outlets are provided, such as the fluid entrance 88 and fluid exit 89 (FIG. 6).

Most preferably an outside layer 86 is provided outside of the mid layer 84 with an air space 87 between the mid layer 84 and outside layer 86. This air space 87 is preferably in communication with the source of elevated pressure air. When elevated pressure air is placed in the air space 87, it causes the heat transfer fluid space 85 and particularly the inside layer 82 to be pressed into intimate contact with the cartridge 100 to maximize heat transfer through the inside layer 82, cartridge 100 and to the heat sink material such as ice I or liquid water L.

While FIG. 6 depicts the heat exchange pouch 80 without any fences extending between the layers 82, 84, typically some form of fences would be provided so that the heat transfer fluid is routed along a path between the layers 82, 84. Also, the fluid entrance 88 and fluid exit 89 are preferably spaced from each other so that only the most fully cooled heat transfer fluid is removed from the heat exchange pouch 80 after maximum residence time of the heat transfer fluid within the heat exchange pouch 80 has occurred. The heat exchange pouch 80 can be either provided merely on a rear side of the compartment of the backpack 12 in which the cartridge 100 is located, or the heat exchange pouch 80 can be provided to wrap around both lateral sides, to and bottom ends, and optionally a front side of this compartment so that the heat exchange pouch 80 transfers heat into the cartridge 100 from all sides. This compartment is preferably sized approximately the same size as the cartridge 100 so that the cartridge 100 is securely held within the compartment when the large zipper 18 (FIG. 1) is closed.

With particular reference to FIGS. 4 and 6 through 9, details of the cartridge 100 of this invention are described, according to a preferred embodiment. The cartridge 100 provides a preferred form of walled enclosure for a heat sink material which is provided to draw heat away from the heat transfer fluid passing along the heat transfer fluid pathway within the system 10 of this invention. Most preferably, the heat sink material is drinkable in liquid form, and is optimally water L/ice I either in pure form or with additives to provide desirable flavor and/or performance enhancing characteristics (i.e. electrolytes, vitamins, minerals, nutritional content, etc.).

The cartridge 100 is removable from the system 10 and replaceable with another cartridge 100, such as when the cartridge 100 is empty or has been heated to the point where it is desirable to replace the cartridge 100 with a new cooled cartridge 100. The cartridge 100 is preferably formed from an injection moldable plastic material with appropriate stiffeners so that the cartridge 100 maintains a similar shape either when containing water L in liquid form or ice I. Most preferably, the compartment in which the cartridge 100 resides can accommodate some slight expansion of the cartridge 100 associated with the expansion of the water when freezing. As an alternative, the cartridge 100 could be formed of a higher heat transfer rate material such as aluminum, or some other suitable material.

The cartridge 100 according to the preferred embodiment includes a wall 101, a generally elongated oval form when viewed in full section from above. Stiffener ribs 102 are provide girding the cartridge 100 horizontally to enhance the stiffness of the cartridge 100. A spine 103 preferably passes entirely from a front side of the cartridge 100 to a rear side of the cartridge 100 so that an interior 105 of the cartridge 100 is generally divided between left and right halves except above and below the spine 103. A handle slot 104 is preferably provided near an upper portion of the cartridge 100 to facilitate ease in handling the cartridges 100. An upper end of the cartridge 100 preferably includes an air port 106 therein which has a nuclear biological hazard filter 108 mounted thereon. The water outlet valve 110 is located at a lower end of the cartridge 100 opposite the air port 106.

The spine 103 and stiffener ribs 102 not only assist in maintaining the rigidity of the cartridge 100 and minimizing the weight of the cartridge 100, but also assist in minimizing the sloshing of ice I within liquid water L in the interior 105 of the cartridge 100. In particular, when the ice I is frozen, the cartridge 100 starts out with a complete block of ice I. As the ice I melts into liquid water L, the ice I remains one large chunk. As heat transfer generally occurs from the walls 101 of the cartridge 100 in towards the spine 103, this large chunk of ice I remains secured to the spine 103 and somewhat maintained in place by the stiffener ribs 102. Thus, the ice I does not tend to shift in a way that would be uncomfortable to the wearer W or affect the balance of the wearer W. Once the ice I has melted to the point where it has broken off of the spine 103, typically enough of the liquid water L has been removed, to the drinking tube 120 as described below, that shifting of ice I and liquid water L within the cartridge 100 is not of significant concern.

As the liquid water L is removed from the cartridge 100 through the drinking tube 120, the air port 106 allows air to be drawn into the cartridge 100 to replace the water L that is being removed. As an alternative, the cartridge 100 could be entirely sealed and provided with flexible walls so that the cartridge 100 would merely collapse as liquid water L is removed through the drinking tube 120. As another alternative, the drinking tube 120 and water outlet valve 110 could be eliminated and the cartridge 100 could merely be provided as a removable heat sink that would be replaced once the heat sink has heated to a temperature where rates of heat transfer are no longer adequate.

Figures 10, 11, 12:
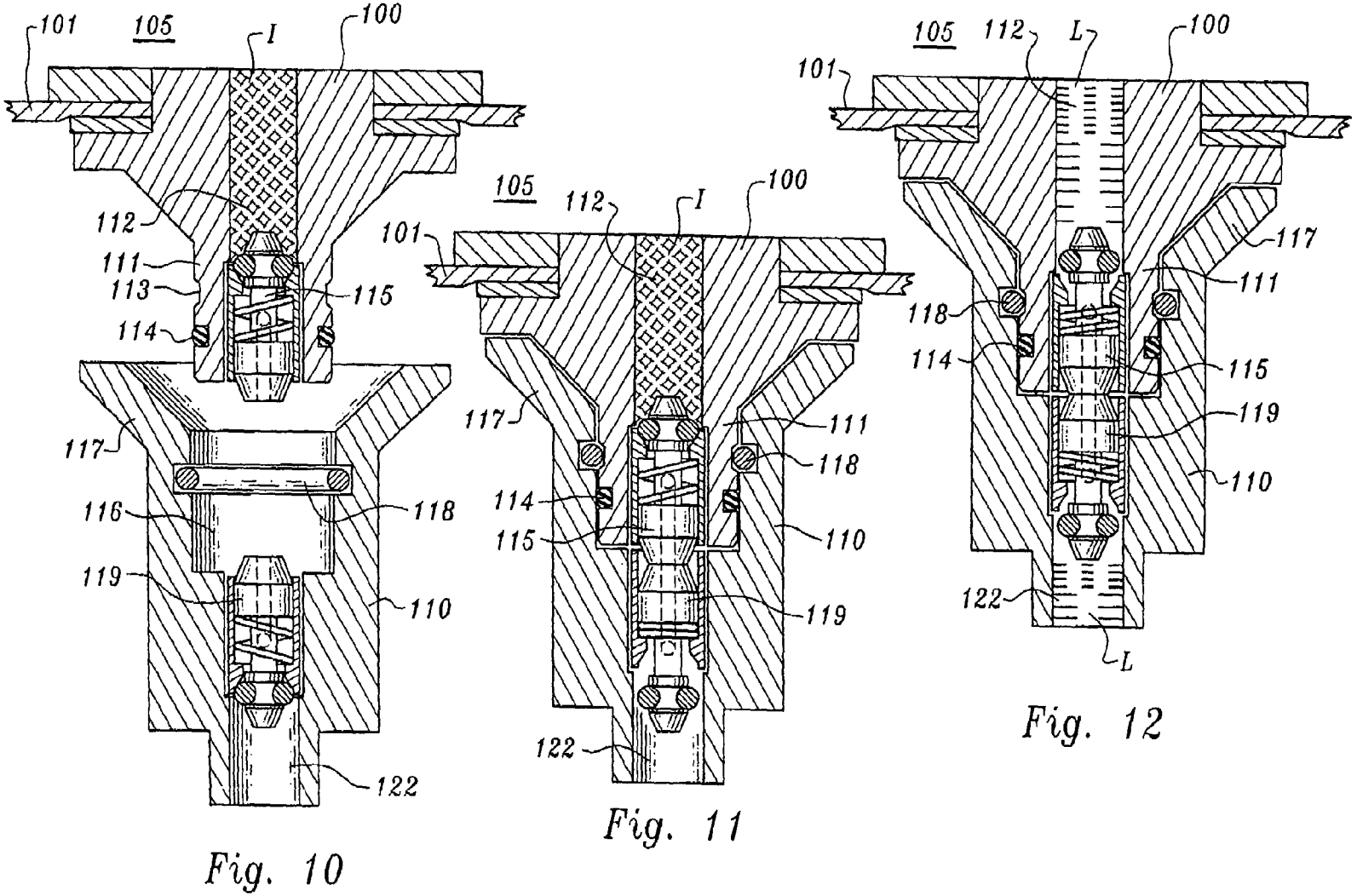
FIGS. 10 through 12 are full sectional views of a heat sink material outlet valve between the cartridge and drinking tube of this invention and showing in detail how the valves therein go from a closed to an open position to facilitate drinking of the heat sink material.

With particular reference to FIGS. 10 through 12, details of the water outlet valve 110 are described, according to this invention. The cartridge 100 is designed so that it can be readily swapped with another cartridge 100 within the system 10, with a minimum of inconvenience. Accordingly, the water outlet valve 110 is provided within a lower portion of the heat exchange pouch 80 within the backpack 12 to be aligned with a plug 111 at a lower end of the cartridge 100. Both the water outlet valve 110 and the plug 111 each include valve elements 115, 119 to seal off the water outlet valve 110 in cartridge 100, except when the cartridge 100 is secured in place adjacent the water outlet valve 110.

In particular, the plug 111 includes a throat 112 in communication with the interior 105 of the cartridge 100 and inside of a neck 113 extending down from the cartridge 100. A sealing ring 115 surrounds a perimeter of the plug 111 to prevent leakage after the cartridge 100 is secured within the water outlet valve 110.

The valve element 115 is located within the throat 112 at a tip thereof. The water outlet valve 110 includes a receiver 116 which is in the form of a cylindrical space sized to receive the plug 111 therein when the cartridge 100 is pushed down into the water outlet valve 110. The receiver 116 has a tapering rim 117 to assist in guiding the plug 111 into proper mating relationship inside the receiver 116.

A locking ring 118 resides within a groove surrounding the receiver 116 and is configured to snap into the neck 113 in the plug 111 to secure the plug 111 of the cartridge 100 within the water outlet valve 110 receiver 116. This locking ring 118 is sufficiently resilient that when the cartridge 100 is pushed down so that the plug 111 extends into the water outlet valve 110, the locking ring 118 is expanded and the plug 111 can seat entirely down into the receiver 116. In a similar fashion, the cartridge 100 can be securely grabbed, such as with the handle slot 104, and lifted upwards so that the locking ring 118 can resiliently expand and release out of the neck 113 in the plug 111 so that the cartridge 100 can be removed from the water outlet valve 110.

When the plug 111 is seated down securely within the receiver 116 a tip of the valve element 115 within the plug 111 abuts a tip of the valve element 119 within the receiver 116 of the water outlet valve 110. These valve elements 115 are each spring loaded to bias them into a closed position. However, when they abut each other, sufficient forces are applied so that the springs can be compressed and the valve elements 115, 119 opened. Most typically, initially the cartridge 100 is filled with ice I and this ice I within the throat 112 blocks the valve element 115 from initially moving when the valve element 115 abuts the valve element 119 of the water outlet valve 110. The spring of the valve element 119 has sufficient travel so that the valve element 119 can entirely open and the cartridge 100 entirely seat with the plug 111 entirely into the receiver 116 even when the valve element 115 cannot move because the ice I is frozen (see particularly FIG. 11). After the ice I begins to melt, the valve element 115 can move (FIG. 12) so that both the valve element 115 and valve element 119 are open. Most preferably, the spring in the valve element 115 is stronger than the spring in the valve element 119, and has less travel, so that when the ice I melts, the valve element 115 can work against the fully open valve element 119 so that both valve elements 119 achieve an open position. Limited travel for the valve element 115 assures that the valve element 115 does not close the valve element 119.

Liquid water L can then flow through the valve element 115 and valve element 119 so that drinking water is supplied through the water outlet valve 110 from the cartridge 100 and into the drinking tube 120. A pathway through the valve elements 115, 119 is shown in broken lines in FIGS. 10 to 12.

With particular reference to FIGS. 1, 3, 4 and 6, details of the drinking tube 120 of this invention are described. The drinking tube 120 is preferably in the form of an elongated flexible straw which extends from the water outlet valve 110 up to a portion of the backpack 12 near the head H of the wearer W, where the wearer W can conveniently suck on a tip 126 of the drinking tube 120. The drinking tube 120 extends from the source 122 adjacent the water outlet valve 110 along the line 124 and up to the tip 126 with routing being variable either within an interior of the backpack 12 or on an exterior of the backpack 12.

When the wearer W sucks on the tip 120 of the drinking tube 120, a slight vacuum causes liquid water L to flow out of the cartridge 100 through the water outlet valve 110 and up to the tip 126 for drinking. When the cartridge 100 is still mostly frozen, the user can alternatively suck and blow to apply forces on the valve elements 115, 119 to free up the valve elements 115, 119 and cause them to open so that liquid water L can flow through the water outlet valve 110. Thus, the cartridge 100 not only provides for cooling of the heat transfer fluid, but also provides a convenient source for drinking water L or other hydration fluid for the benefit of the wearer W.

With particular reference to FIGS. 4 through 6 details of the air pump 130 are described. In a most basic form of this invention, it is conceivable that the air pump 130 could be omitted. Most preferably, however, the air pump 130 is utilized so that a source of slightly elevated pressure air is provided to optimize performance of the system 10. In particular, the air pump 130 is powered by a motor 131 receiving electric power from batteries 132 (FIG. 4). Most typically, the air pump 130 has lower power than the heat transfer fluid pump 30, such that conceivably only three volts of electric potential are required and, as an option, only two of the four batteries can be utilized for powering the air pump 130.

A filter 133 is preferably provided so that contamination of air passing into the air pump 130 is avoided. The air pump 130 provides various different lines where pressurized air can be of assistance in operation of the system 10. For instance, a prime line 134 extends to the reservoir 20 so that air within the reservoir 20 can be of a slightly elevated pressure and assist in priming the heat transfer fluid pump 30, and avoid contamination or other damage to the heat transfer fluid 20 should air bubbles be present in the heat transfer fluid. An auxiliary outlet line 135 is provided where any auxiliary air pressure power systems can be coupled to the system 10 of this invention.

A pouch line 136 is provided which passes to the air space 87 of the heat exchange pouch 80 described in detail above. A cummerbund line 137 passes to the cummerbund 140 where air pressure can assist in pressing the vest 40 against the wearer W for maximum heat transfer. An air valve 139 is preferably provided adjacent the air pump 130 to allow further control of the air pump 130 of the system 10. A heat transfer fluid pressure line 138 is also provided which allows air to mix with the heat transfer fluid before return to the reservoir 20 and to assist in maintaining positive pressure for the heat transfer fluid pathway.

With particular reference to FIGS. 4, 13 through 15, and 17, details of the cummerbund 140 of this invention are described, according to a preferred embodiment. The cummerbund 140 is optionally provided to enhance heat transfer between the vest 40 and the wearer W. In particular, the cummerbund 140 includes an air inlet 141 passing into a series of columns 142 spaced apart by dividers 143. These columns 142 and dividers 143 keep the cummerbund 140 in a generally low profile form. A front closure 145 is provided similar to the sternum joint 56 of the vest 40 so that the cummerbund 140 can gird the wearer W about the torso T.

With particular reference to FIG. 4, details of a heat transfer fluid filler source 150 are described. At times it is required that heat transfer fluid be provided to initially fill the various different heat transfer fluid pathways of the system 10, or to replace lost fluid, or to recharge the system 10 and replace contaminated or otherwise deteriorated heat transfer fluid. Most preferably, a heat transfer fluid filler source 150 is provided which includes a tank 152 of new heat transfer fluid. An outlet 154 is provided which feeds to a portion of the heat transfer fluid pathway just upstream from the heat transfer garment, such as the vest 40 or cap 60. The tank 150 can be provided under pressure so that this pressure is utilized to drive the heat transfer fluid into the vest 40, cap 60 and into the various different lines making up the heat transfer fluid pathway, without requiring that the pump 30 be simultaneously operational at a time when it might be dry. One way to pressurize the tank 150 and drive the heat transfer fluid out of the tank 150 and into the system 10 is to make the pump 30 reversable, and configure the pump 30 within the system to allow it to so operate. Most preferably, the pump 30 is a form of gear pump to particularly facilitate such reversability. Either a transmission or reversable motor 31 are utilized to drive the pump 30 in the reverse direction when so required As air or contaminated heat transfer fluid is driven out of the various heat transfer fluid pathways and returned back to the reservoir 20, a potential over pressure condition within the reservoir 20 is avoided by having an air/overflow inlet 156 extending from the reservoir 20 back to the heat transfer fluid filler source 150. Once the system has been entirely charged, the heat transfer fluid filler source 150 can be disconnected from the system 10.

With further reference to FIG. 4, various check valves 160 are provided to maintain a desired direction of heat transfer fluid flow through the system and a desired direction of air flow through the system, as well as to keep the heat transfer fluid out of the air lines and to maintain elevated pressure within desired portions of the heat transfer fluid and air pathways. Also, miscellaneous disconnects 170 are provided at various different locations within the system 10. These disconnects allow the various different subcomponents of the system 10 to be readily attached and detached such as during maintenance.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. A personal cooling and hydration system, comprising in combination:

a heat transfer fluid;

said heat transfer fluid contained within a heat transfer fluid pathway;

said pathway adapted to be located proximate to a body of a person, such that heat can be transferred from the body to said heat transfer fluid when the body is hotter than said heat transfer fluid;

a heat sink material;

said heat sink material adapted to be drinkable;

a walled enclosure;

said walled enclosure adapted to hold said heat sink material within an interior thereof;

said pathway adapted to be located proximate to an exterior of said walled enclosure, such that heat can be transferred from said heat transfer fluid to said heat sink material when said heat transfer fluid is hotter than said heat sink material;

an outlet for said heat sink material to facilitate drinking thereof; and wherein an elevated pressure air space is located on a side of said pathway opposite said walled enclosure where said pathway is located proximate to said exterior of said walled enclosure, such that said elevated pressure air space applies a force tending to press said pathway against said exterior of said walled enclosure.

2. The system of claim 1 wherein said pathway is at least partially configured as a circuit with a pump therein, said pump adapted to circulate said heat transfer fluid within said circuit.

3. The system of claim 1 wherein said walled enclosure is configured as a cartridge, said cartridge adapted to be removably replaced from adjacent said pathway, such as for replacement with a new second cartridge colder than said cartridge previously adjacent said pathway.

4. The system of claim 3 wherein said pathway includes a pouch, said pouch having a heat transfer surface inside layer adapted to surround said cartridge and separate said heat transfer fluid pathway and said heat transfer fluid from said walled enclosure of said cartridge.

5. The system of claim 4 wherein said pouch is located within a backpack adapted to be worn by the person.

6. The system of claim 5 wherein said pathway includes a vest adjacent a torso of the person, said vest including an inner layer adapted to separate said heat transfer fluid from the torso of the person, said inner layer adapted to allow heat transfer from the torso of the person to said heat transfer fluid within said pathway within said vest.

7. The system of claim 6 wherein said pathway includes a cap adapted to be worn upon a head of the person, said cap adapted to deliver said heat transfer fluid adjacent the head of the person while keeping said heat transfer fluid from directly contacting the head of the person and allowing heat transfer between said heat transfer fluid and the head of the person.

8. The system of claim 1 wherein an elevated pressure air space is located adjacent said pathway where said pathway is located proximate to the body of the person and with said elevated pressure air space on a side of said pathway opposite said person, such that said elevated pressure air space tends to apply a force on said pathway encouraging said heat transfer fluid within said pathway into intimate contact with the body of the person.

9. The system of claim 1 wherein said pathway includes a hot path and a cold path in parallel with each other, said cold path adapted to give more heat from said heat transfer fluid to said heat sink material than said hot path, and a divider in said pathway, said divider adapted to adjustably split said heat transfer fluid between said hot path and said cold path.

10. An easily and quickly rechargeable personal cooling and hydration system, comprising in combination:

a cartridge adapted to be filled with a drinkable heat sink material;

a heat sink material outlet coupled to said cartridge;

a heat transfer fluid contained within a heat transfer fluid pathway, said pathway routed past and in heat exchange relationship with said cartridge;

said pathway also adapted to be routed past and in heat exchange relationship with a body of a person to be cooled;

said cartridge adapted to be swapped with another similar cartridge, such as when a first said cartridge is empty or no longer sufficiently cool;

wherein said pathway includes a pouch, said pouch sized to receive said cartridge therein, said pouch including an inside layer adapted to reside between the heat transfer fluid and said cartridge, while facilitating heat transfer from the heat transfer fluid to the heat sink material within said cartridge; and wherein said pouch includes an elevated pressure air space on a side of said pathway opposite said cartridge, such that said elevated pressure air space tends to apply a force pressing said pathway and said inside layer against said cartridge, such that heat transfer between said heat transfer fluid within said pathway and the heat sink material within said cartridge is enhanced.

11. The system of claim 10 wherein said pathway includes at least one garment item having an inner layer adapted to be closer to the body of the person, and an outer layer adapted to be further from a body of the person than said inner layer, said inner layer and said outer layer spaced apart by width of said pathway, said inner layer and said outer layer adapted to be suspended upon a portion of the body of the person, such that said pathway is worn by the person.

12. The system of claim 11 wherein said pathway includes a vest portion, said vest portion adapted to be worn upon a torso of the person.

13. The system of claim 12 wherein said pathway includes a cap portion adapted to worn upon a head of the person.

14. The system of claim 10 wherein said pathway includes a hot path and a cold path in parallel with each other on at least a portion of said pathway, said cold path adapted to give more heat from the heat transfer fluid to said heat sink material within said cartridge than said hot path, and a divider in said pathway, said divider adapted to adjustably split the heat transfer fluid between said hot path and said cold path.

15. The system of claim 10 wherein said cartridge includes an air inlet therein, such that as drinkable heat sink material is removed from said cartridge air can enter said cartridge to replace the heat sink material.

16. The system of claim 15 wherein said air inlet includes a nuclear and biological hazardous material filter.

17. The system of claim 10 wherein said cartridge includes a spine passing entirely through a central portion of said cartridge, such that an interior of said cartridge completely surrounds said spine except where said spine joins with walls forming said cartridge, said spine passing from a forward side of said cartridge to a rearward side of said cartridge.

* * * * *